US011458359B2

(12) United States Patent
An

(10) Patent No.: US 11,458,359 B2
(45) Date of Patent: Oct. 4, 2022

(54) CHEST EXPANDER

(71) Applicant: Tae Jin An, Incheon (KR)

(72) Inventor: Tae Jin An, Incheon (KR)

( * ) Notice: Subject to any disclaimer, the term of this patent is extended or adjusted under 35 U.S.C. 154(b) by 216 days.

(21) Appl. No.: 16/886,084

(22) Filed: May 28, 2020

(65) Prior Publication Data

US 2020/0376333 A1 Dec. 3, 2020

(30) Foreign Application Priority Data

May 31, 2019 (KR) ..... 10-2019-0064675

(51) Int. Cl.
*A63B 23/02* (2006.01)
*A63B 21/00* (2006.01)
*A63B 21/045* (2006.01)

(52) U.S. Cl.
CPC ..... *A63B 23/02* (2013.01); *A63B 21/00043* (2013.01); *A63B 21/00069* (2013.01); *A63B 21/045* (2013.01); *A63B 21/4035* (2015.10)

(58) Field of Classification Search
CPC ..... A63B 23/02; A63B 21/00043; A63B 21/00069; A63B 21/045; A63B 21/4035; A63B 21/0087; A63B 23/1209; A63B 2208/12; A63B 2209/08; A63B 2225/09; A63B 21/0085; A63B 21/05; A63B 23/12; A63B 21/0602
See application file for complete search history.

(56) References Cited

U.S. PATENT DOCUMENTS 5,613,928 A * 3/1997 Laudone ..... A63B 23/03533 482/99
5,690,596 A * 11/1997 Parker ..... A63B 21/0004 482/121
5,743,830 A * 4/1998 Ho ..... A63B 23/12 482/44

(Continued)

FOREIGN PATENT DOCUMENTS

CN 104853815 A 8/2015
CN 206586688 U 10/2017

(Continued)

OTHER PUBLICATIONS

First Office Action issued in corresponding Chinese Application No. 202010474852.X dated May 19, 2021 (25 pages).

*Primary Examiner* — Andrew S Lo
(74) *Attorney, Agent, or Firm* — Osha Bergman Watanabe & Burton LLP

(57) ABSTRACT

The present invention relates to a chest expander, wherein the chest expander includes a pair of operating arms that are connected by a rotating shaft to approach or be spaced apart from each other, a plurality of elastic force adjusting holes formed as through holes in a longitudinal direction of the operating arm, elastic members that are disposed between the operating arms to cross and configured to provide an elastic force in a direction in which the operating arms are spaced apart from each other when the operating arms approach each other, and elastic force adjusting parts that allow one end portions of the elastic members to move along the elastic force adjusting holes and to be fixed so that lengths of the elastic members between the operating arms are changed so as to adjust strength levels of the elastic forces of the elastic members.

15 Claims, 9 Drawing Sheets

(56) References Cited

U.S. PATENT DOCUMENTS

| | | | | |
|---|---|---|---|---|
| 7,789,815 | B2 * | 9/2010 | An | A63B 23/03533 482/126 |
| 9,211,430 | B1 * | 12/2015 | Higginbotham, III | A63B 21/4035 |
| 9,962,571 | B2 * | 5/2018 | Dennis | A63B 23/03533 |
| 2006/0211551 | A1 * | 9/2006 | Mandell | A63B 21/4035 482/121 |
| 2007/0238590 | A1 * | 10/2007 | Jin | A63B 21/0004 482/121 |
| 2008/0051271 | A1 * | 2/2008 | Mandell | A63B 21/4035 482/122 |
| 2008/0076647 | A1 * | 3/2008 | Fine | A63B 23/03516 482/44 |
| 2009/0042701 | A1 * | 2/2009 | Tsai | A63B 23/1272 482/121 |

FOREIGN PATENT DOCUMENTS

| | | | |
|---|---|---|---|
| KR | 20010000301 | A | 1/2001 |
| KR | 100673581 | B1 | 1/2007 |
| KR | 20070006256 | A | 1/2007 |
| KR | 101355679 | B1 | 2/2014 |
| KR | 101576738 | B1 | 12/2015 |

* cited by examiner

CHEST EXPANDER

CROSS-REFERENCE TO RELATED APPLICATION

This application claims priority to and the benefit of Korean Patent Application No. 2019-0064675, filed on May 31, 2019, the disclosure of which is incorporated herein by reference in its entirety.

BACKGROUND

1. Field of the Invention

The present invention relates to a chest expander, and more specifically, to a chest expander of which force is adjustable.

2. Discussion of Related Art

Generally, chest expanders are exercise equipment used to train muscles of arms, shoulders, and the like. The chest expander includes a head part in which springs are installed and a pair of operating arms operatively connected with the springs.

When a user grips left and right operating arms with two hands and applies force thereto so that the operating arms approach each other, muscular strength is provided to arms and shoulders, and when the user is relaxed, the operating arms return to the original separated positions. Thus, operations in which the muscles of the arms and shoulders are tensed and relaxed are repeated so as to allow for the user to exercise.

However, the conventional chest expanders have disadvantages in that users cannot adjust strength levels to fit muscular strength of the users and should use separate chest expanders according to a level of exercise.

PRIOR ART DOCUMENTS

Patent Documents

Korean Registered Patent No. 1576738 (Dec. 4, 2015)

SUMMARY OF THE INVENTION

The present invention is directed to providing a chest expander of which a strength level is adjustable to fit muscular strength of the user in the case of physical exercise.

According to an aspect of the present invention, there is provided a chest expander which includes a pair of operating arms that are connected by a rotating shaft to approach or be spaced apart from each other, a plurality of elastic force adjusting holes formed as through holes in a longitudinal direction of the operating arm, elastic members that are disposed between the operating arms to cross and configured to provide an elastic force in a direction in which the operating arms are spaced apart from each other due to compression deformation that causes a decrease in length when the operating arms approach each other, and elastic force adjusting parts that allow one end portions of the elastic members to move along the elastic force adjusting holes and to be fixed so that lengths of the elastic members between the operating arms are changed so as to adjust strength levels of the elastic forces of the elastic members.

The pair of operating arms may include teeth-shaped parts formed on upper end portions thereof and including gear teeth partially engaged to operatively rotate at a fixed position.

The chest expander may further include an operating-arm rotation limiting part formed on an upper portion of the operating arm and configured to limit approach of the operating arms when the operating arms approach each other or separation of the operating arms when the operating arms are spaced apart from each other.

The chest expander may further include a head part that includes an installation space in which upper end portions of a pair of connection arm parts are accommodated and installed and includes a front plate and a rear plate that are accommodated in the installation space and fixed thereto to be spaced apart from each other, wherein the connection arm parts are rotatable about the rotating shaft and face each other.

The elastic force adjusting part may allow one end portion of the elastic member to be fixed to any one of the elastic force adjusting hole formed to pass through the operating arm on a rotation route of the one end portion of the elastic member with respect to the other end portion of the elastic member in a longitudinal direction so as to adjust a strength level of the elastic force of the elastic member.

The operating-arm rotation limiting part may include rotation limiting surfaces to limit rotation in a direction in which the operating arms approach each other by coming into contact with each other, wherein the rotation limiting surfaces are formed below teeth-shaped parts formed on both ends of the operating arms accommodated in the head part.

The operating-arm rotation limiting part may include a stopper insertion hole formed to pass through the front plate and the rear plate of the head part, and facing parts formed above teeth-shaped parts to face each other, wherein the teeth-shaped parts have gear teeth formed on both end portions of the operating arms accommodated in the head part to be partially engaged in a facing direction, and a stopper that passes through the stopper insertion hole to be inserted into and fixed to a gap between the facing parts of the operating arms, wherein the operating-arm rotation limiting part limits a rotation distance between the operating arms spaced apart by the stopper.

The operating-arm rotation limiting part may include a stopper that is rotated by a hinge shaft between the front plate and the rear plate of the head part and includes a rotation knob formed on an upper portion thereof and a hook formed on a lower portion thereof, and a locking surface and a locking protrusion formed on upper end portions of the operating arms and locked and fixed by the hook, wherein the operating-arm rotation limiting part limits a rotation distance between the operating arms spaced apart by the stopper fixed to a gap between the locking surface and the locking protrusion.

The elastic force adjusting hole may include a plurality of through holes consecutively formed on the rotation route of one end portion of the elastic member.

The elastic force adjusting hole may include a straight line-shaped slide hole formed on the rotation route of the one end portion of the elastic member to allow one end portion of the elastic member to move, and a plurality of fixing holes that are formed at intervals to cross the slide hole and allow one end portion of the elastic member to be inserted into and fixed thereto.

The front plate and the rear plate may be disposed with an interposing part interposed therebetween, wherein the interposing part is installed on an upper portion of the operating arm to be rotatable without interference with surfaces of the front and rear plates and has a thickness corresponding to the operating arm.

The front plate and the rear plate may be disposed with a first interposing part and a second interposing part disposed therebetween, the stopper may be rotatably disposed between the first interposing part and the second interposing part, and a coupling groove may be formed between facing surfaces of the first and second interposing parts and may have a protrusion part of the stopper rotatably coupled to the coupling groove.

The stopper may include a grip that is formed in a rod shape corresponding to a shape of the stopper insertion hole and protrudes forward, and a supporting piece that is inserted into the stopper insertion hole and a gap between the facing surfaces and supported thereon.

The facing parts may be formed to have a gap which becomes larger in an upward direction, and the stopper insertion hole is provided in a plurality of stopper insertion holes formed to pass through the front and rear plates in a vertical direction corresponding to the facing part so that a gap between the operating arms is adjusted by a distance between the facing parts when the stopper is inserted into and fixed to the stopper insertion hole.

The stopper may include a permanent magnet inserted into an insertion hole formed in the supporting piece, wherein the permanent magnet is attached to a surrounding part of the front plate or the rear plate so as not to come out of the stopper insertion hole while being inserted into the stopper insertion hole.

The grip of the stopper may include a nut hole that corresponds to an outer circumferential diameter of the nut so that the nut of one end portion of the elastic member is unfastened or fastened.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
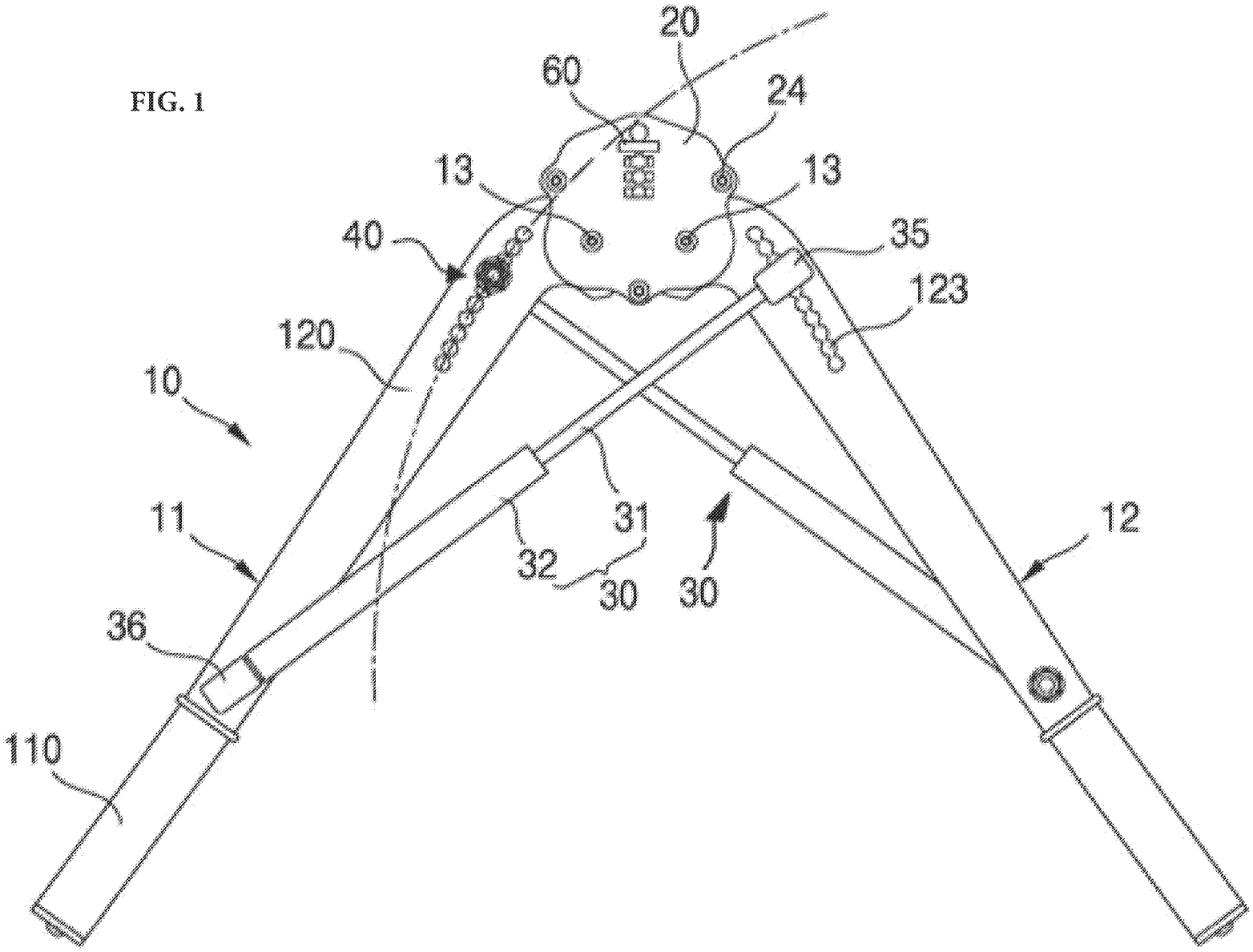
FIG. 1 is a perspective view illustrating a chest expander according to one embodiment of the present invention.
Figure 2:
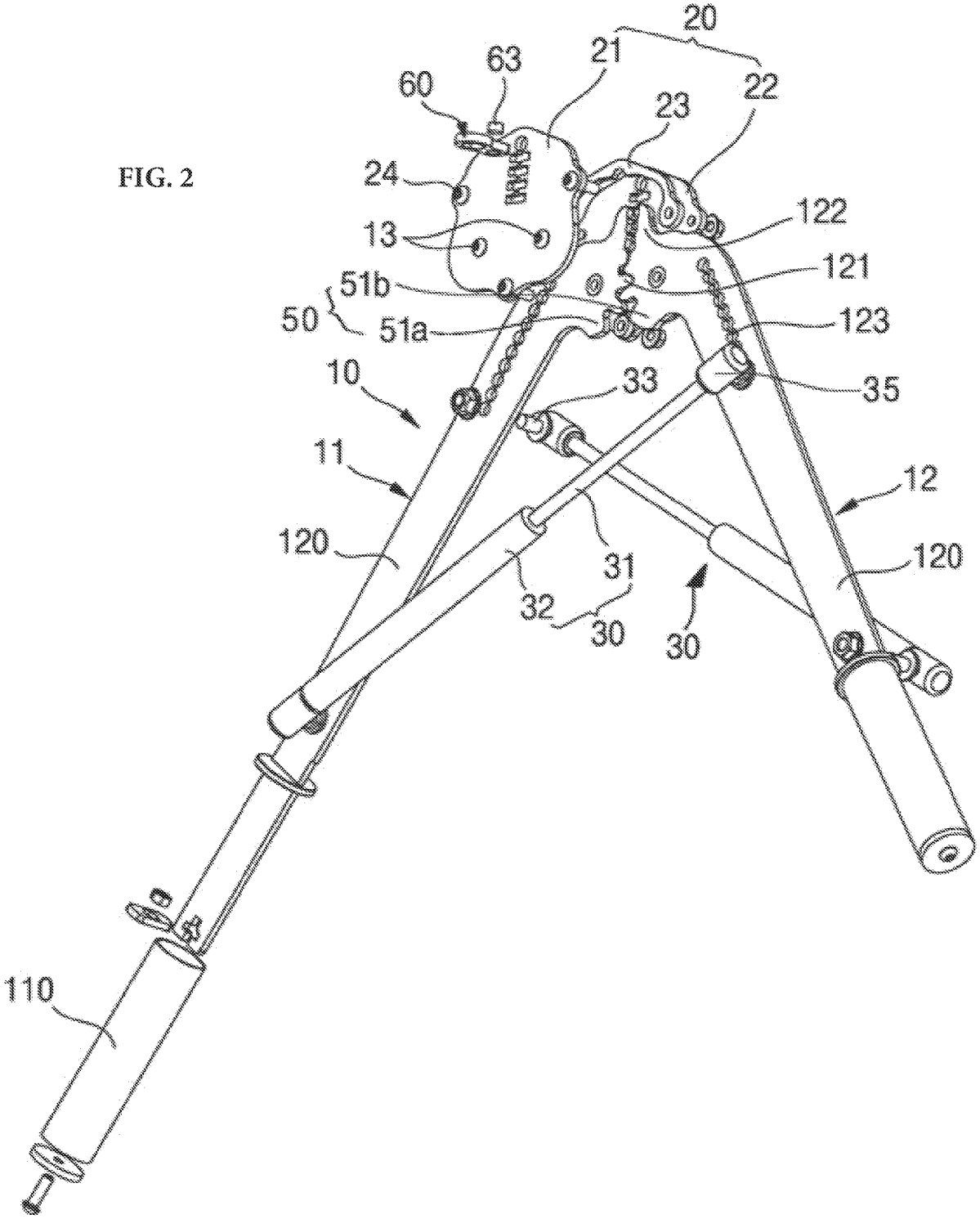
FIG. 2 is an exploded perspective view illustrating the chest expander according to one embodiment of the present invention.

While the present invention is susceptible to various modifications and various forms, embodiments of the present invention will be described in detail. However, it should be understood that there is no intent to limit the invention to the particular forms disclosed, but on the contrary, the invention is to cover all modifications, equivalents, and alternatives falling within the spirit and scope of the invention. In describing each drawing, similar reference numerals are used for similar components.

The terms are used only for the purpose of distinguishing one component from other components. The terms used herein are for the purpose of describing particular embodiments only and are not intended to limit the invention. Singular forms used herein are intended to include plural forms unless explicitly indicated otherwise.

Hereinafter, embodiments of the present invention will be described in detail with reference to the accompanying drawings.

Referring to the accompanying drawings, a chest expander according to one embodiment of the present invention includes a pair of operating arms 10 that each include a first arm 11 and a second arm 12 provided at the left and right side, a head part 20 that includes rotating shafts 13 to perform rotational operation in which the first arm 11 and the second arm 12 approach or are spaced apart from each other, elastic members 30 that are provided between the operating arms 10 and provide an elastic force in a separation direction in which the operating arms 10 are spaced apart from each other, elastic force adjusting parts 40 that adjust an elastic force of the elastic members 30 by changing a separation distance of the elastic members 30 between the operating arms 10, and an operating-arm rotation limiting part 50 that limits approach of the operating arms when the operating arms 10 approach each other or limits separation of the operating arms 10 when the operating arms 10 are spaced apart from each other.

The operating arms 10 are formed of a plate-shaped member and include grip parts 110 having a grip fixed to a lower portion thereof and connection parts 120 connecting the grip parts 110 to upper end portions of the operating arms 10 positioned in the head part 20.

The connection arm parts 120 are formed of a plate-shaped member, and upper end portions of the pair of connection arm parts 120 rotate about the rotating shafts 13 in the head part 20 to approach or be spaced apart from each other.

Figure 3:
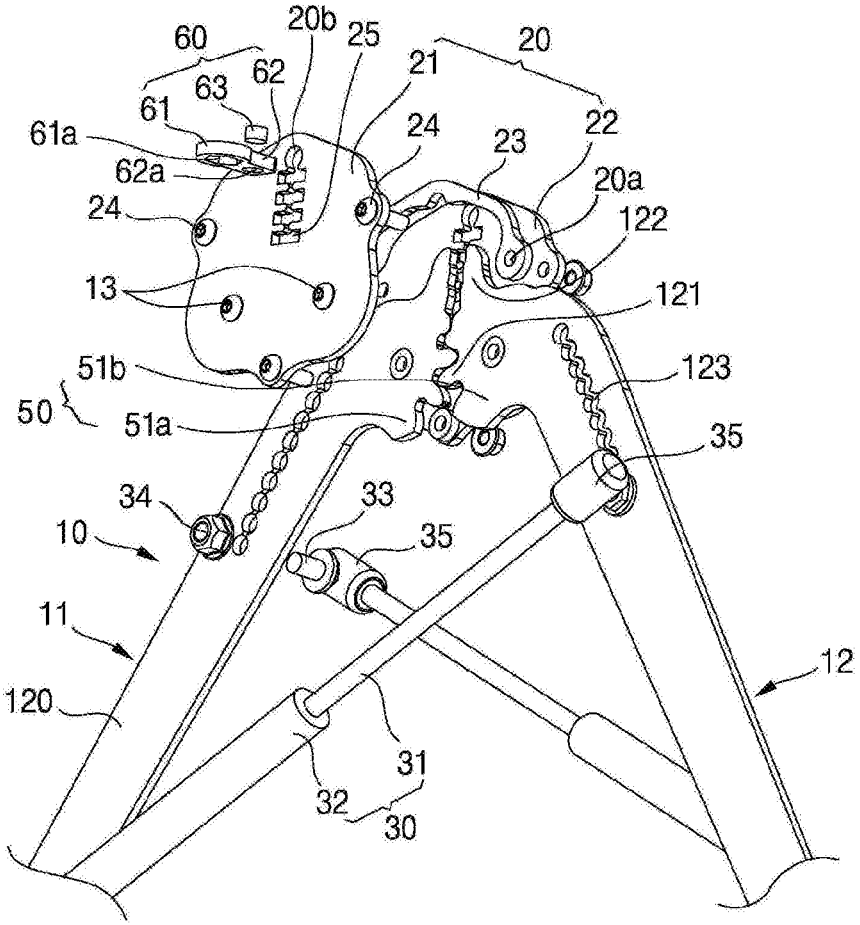
FIG. 3 is an enlarged view illustrating a head part in FIG. 2.
Figure 4:
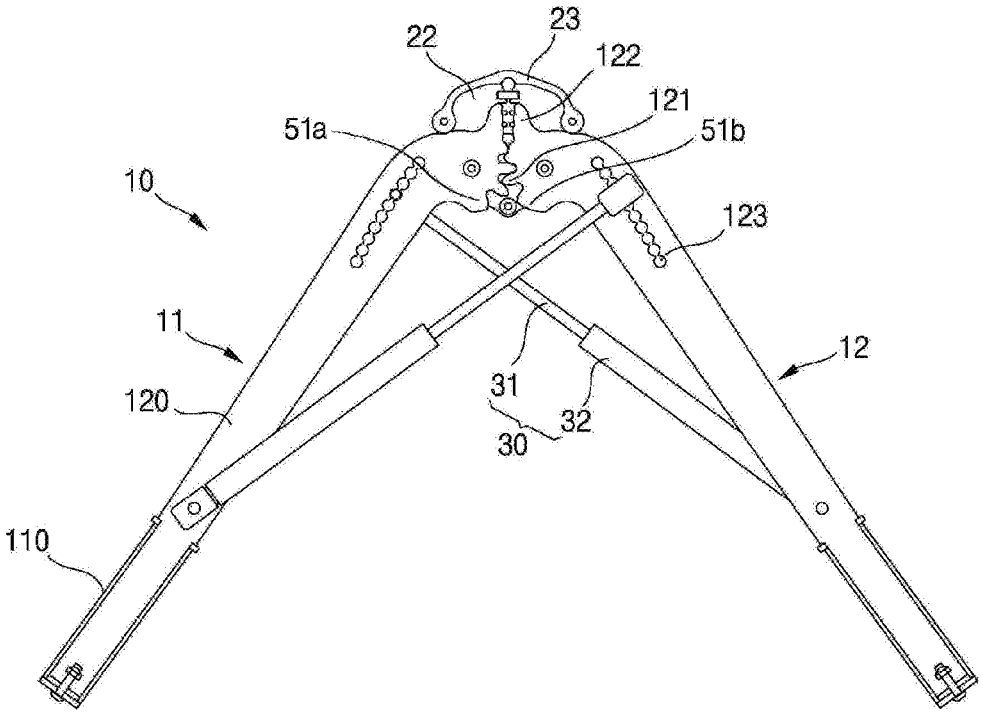
FIG. 4 is a cross-sectional view illustrating a state in which operating arms of the chest expander according to one embodiment of the present invention are spaced apart from each other.

As shown in FIG. 3, an installation space, in which the pair of connection arm parts 120 that face each other and are rotatably provided, is formed in the head part 20, and the head part 20 includes a front plate 21 and a rear plate 22 fixed to be spaced apart from each other. The head part 20 includes the rotating shafts 13 to which the connection arm parts 120 of the operating arms 10 are connected. The rotating shafts 13 are positioned on both sides of the head part 20 and rotatably connected with the upper end portions of the connection arm parts 120. That is, the upper end portions of the connection arm parts 120 are installed in the installation space between the front plate 21 and the rear plate 22 to be rotatable about the rotating shafts 13.

Interposing parts 23 have a thickness corresponding to the connection arm part 120 and are installed on upper portions of the connection arm parts 120 to be interposed between the front plate 21 and the rear plate 22 so that the connection arm parts 120 easily rotate between the front plate 21 and the rear plate 22 without interference with surfaces of the front plate 21 and the rear plate 22. The interposing part 23 may include fixing holes 20*a* that allow fixing members 24 for fixing the front plate 21 and the rear plate 22 to pass therethrough and to be inserted thereinto.

Hooking holes 20*b* are formed in upper end portions of the front plate 21 and the rear plate 22. A user may store the chest expander by hanging the chest expander using a hook or the like attached to a wall through the hooking hole 20*b*. According to the present invention, since the head part 20 is formed by coupling the front plate 21 to the rear plate 22, the hooking hole 20*b* may be easily formed.

According to the present invention, since the hooking hole 20*b* has a hole structure that passes through the front plate 21 and the rear plate 22, the hooking hole 20*b* is easily formed, and since the hooking hole 20*b* has a structure that passes through the head part 20, the head part 20 supports a load of the chest expander, and thus the robustness of a portion of the hooking hole 20*b* can be secured.

The upper end portions of the connection arm parts 120 of the first arm 11 and the second arm 12 are rotatably connected to the rotating shafts 13 of the head part 20, teeth-shaped parts 121 have gear teeth to be partially engaged in a facing direction and are formed in the upper end portions of the connection arm parts, and facing portions 122 are roughly protrusion shaped and are formed above the teeth-shaped parts 121 in a facing direction.

The teeth-shaped parts 121 are formed on the upper end portions of the pair of operating arms 10 and partially engaged so that the operating arms 10 operatively rotate at a fixed position.

The operating arms 10 may rotate about the rotating shafts 13 in a direction in which the operating arms approach or are spaced apart from each other. Since the operating arms 10 are operatively connected with the elastic members 30, when the user applies force at exercise starting positions that correspond to positions of the operating arms 10 in a state in which the elastic members 30 are released (uncompressed) so that the operating arms 10 approach each other, the elastic members 30 are compressed to provide force that prevents movement of the operating arms 10.

When the operating arms 10 are moved to an approaching position that corresponds to a position at which the operating arms 10 maximally approach each other, and the force that is applied to the operating arms 10 by the user is removed, the operating arms 10 return to the exercise starting positions due to a repulsive force of the elastic members 30 against the compressive force. The user may exercise in a manner in which the operating arms 10 repeatedly move between the exercise starting positions and the approaching positions.

The elastic members 30 are disposed between the operating arms 10 and are formed to provide an elastic force in a direction in which the operating arms 10 are spaced apart from each other due to compression deformation caused by a decrease in lengths of the elastic members 30 when the operating arms 10 approach each other. The elastic members 30 are operated by gas springs that have an elastic force using a volume change in compressible gas in tubes 32 due to movement of rods 31, and end portions of the rods 31 positioned in the tubes 32 are moved, and thus the rods 31 reciprocate while movement of the tubes 32 are guided. Therefore, when the elastic members 30 are formed in the maximum length, the elastic members 30 are compressed or uncompressed in length without bending, and thus an elastic force can be stably provided.

Upper coupling parts 35 and lower coupling parts 36 are formed on end portions of the rods 31 and the tubes 32 of the elastic members 30 which are coupled to cross in the operating arms 10, wherein the upper coupling part 35 and the lower coupling part 36 are free ends and fixed ends coupled by nuts 34 and coupling bolts 33 that are separate.

A plurality of elastic force adjusting holes 123 through which the coupling bolts 33 of the upper coupling parts 35 of the elastic members 30 pass are consecutively formed on rotation routes of the upper coupling parts 35 of the elastic members 30 with respect to the lower coupling parts 36 of the elastic members 30 in the first arm 11 and the second arm 12 of the connection arm parts 120. The elastic force adjusting holes 123 are formed in the operating arm part 120 in a length direction and include a plurality of through holes on the rotation routes of the upper coupling parts 35 of the elastic members 30.

Therefore, the elastic force adjusting parts 40 are individually inserted into and fixed to any one of the elastic force adjusting holes 123 at positions to be fixed while the coupling bolts 33 of the upper coupling parts 35 are on the rotation routes and may easily adjust strength levels corresponding to muscular strength of the user by adjusting the lengths of the elastic members 30, that is, the elastic force adjusting part 40.

The upper coupling parts 35 of the elastic members 30 may pass through any one of the elastic force adjusting holes 123 and be fixedly inserted thereinto using the elastic force adjusting parts 40 that are symmetrical to the connection arm parts 120 of the first arm 11 and the second arm 12, and thus the upper coupling parts 35 of the elastic members 30 may adjust the strength of the chest expander to various levels to fit muscular strength of the user. In this case, when the upper coupling parts 35 of the elastic members 30 are fixedly inserted into the elastic force adjusting holes 123 to be fixed, the upper coupling parts 35 may be inserted into the positions corresponding to the elastic force adjusting holes 123 on the first arm 11 and the second arm 12.

When the separation level of the connection arm parts 120 is greater than a predetermined level so that the elastic members 30 are compressed, the upper coupling parts 35 of the elastic members 30 are positioned on the rotation routes of the elastic force adjusting holes 123, and thus the positions of the elastic members 30 for the elastic force adjusting holes 123 are adjustable. In this case, facing parts 122 of the connection arm parts 120 that face each other may be positioned by moving in a direction in which the connection arm parts approach each other.

The strength of elastic force can be adjusted by moving the upper coupling parts 35 of the pair of elastic members 30 between the first arm 11 and the second arm 12 of the operating arms 10 to any one of the elastic force adjusting holes 123. In this case, when the nuts 34 fixed to the coupling bolts 33 of the upper coupling parts 35 of the elastic members 30 are unfastened, the coupling bolts 33 are moved and inserted into the elastic force adjusting holes 123 to fit the muscular strength of the user, and the nuts 34 may be fixed.

Figure 5:
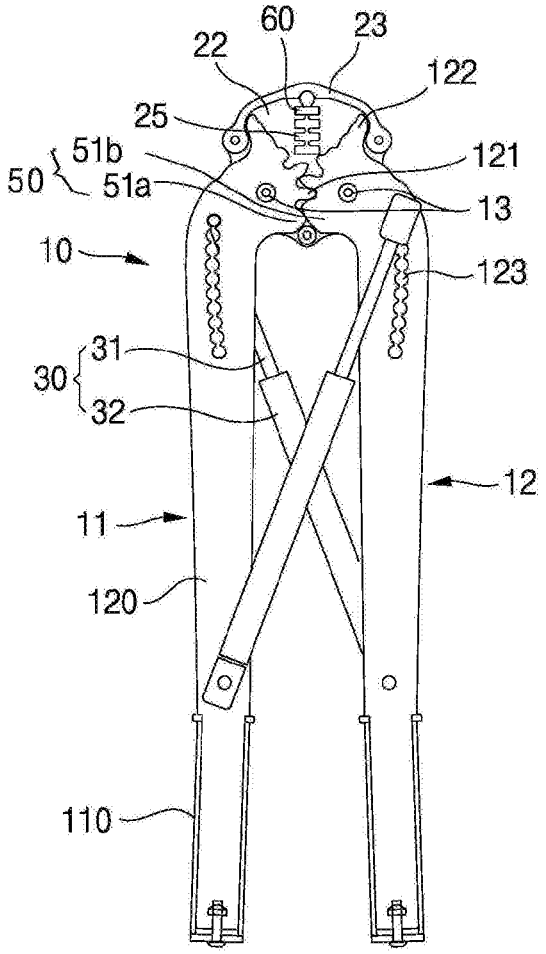
FIG. 5 is a cross-sectional view illustrating a state in which the operating arms of the chest expander according to one embodiment of the present invention approach each other.

As shown in FIG. 5, according to the present invention, the connection arm part 120 including the first arm 11 and the second arm 12 includes the operating-arm rotation limiting part 50. When the connection arm parts 120 rotate about the rotating shafts 13 in the direction in which the connection arm parts approach each other so that the elastic members are compressed, rotation limiting surfaces 51*a* and 51*b* having another tooth shape and provided on both lower portions of teeth-shaped parts 121 come into contact with each other, and thus rotation of the operating arms 10 in the direction approaching each other are limited, and the rotations of the first arm 11 and the second arm 12 are stopped. That is, when the operating arms 10 approach each other with respect to the rotating shafts 13, the first arm 11 and the second arm 12 may rotate only to the positions at which the rotation limiting surface 51*a* of the first arm 11 comes into contact with the rotation limiting surface 51*b* of the second arm 12. In this case, the positions of the rotation limiting surfaces 51*a* and 51*b* may become the stopping positions of the operating arms 10.

Further, as described above, the operating-arm rotation limiting part 50 limits a separation degree of the first arm 11 and the second arm 12 while the positions of the upper coupling parts 35 of the elastic members 30 are adjusted. That is, when the user applies force so that the first arm 11 and the second arm 12 approach each other and removes the force, the lengths of elastic members 30 are increased, and the first arm 11 and the second arm 12 rotate about the rotating shafts 13 in the direction in which the first and second arms are spaced apart from each other, and thus the separation degree of the first and second arms 11 and 12 should be limited so that the first and second arms 11 and 12 are not spaced apart to the maximum rotation distance. That is, when the operating arms 10 are spaced apart from each other over the predetermined range, the upper coupling parts 35 of the elastic members 30 are positioned on the rotation routes of the elastic force adjusting holes 123. Therefore, to prevent this, the separation degree of the first and second arms 11 and 12 should be limited.

According to the present invention, when the first arm 11 and the second arm 12 of the operating arms 10 rotate about the rotating shafts 13 in the direction in which the first and second arms are spaced apart from each other, the facing parts 122 of the connection arm parts 120 come into contact with both sides of the interposing parts 23 interposed between the front plate 21 and the rear plate 22 in advance before coming into contact with each other so as to limit a separation degree of the first and second arms. The positions of the upper coupling parts 35 of the elastic members 30 for the elastic force adjusting holes 123 of the connection arm parts 120 are adjusted along the rotation routes of the elastic force adjusting holes 123 so as to be positioned at the positions at which the strength of the elastic force are adjusted.

Therefore, when the first arm 11 and the second arm 12 of the operating arms 10 rotate in the separation direction with respect to the rotating shafts 13, before the upper coupling parts 35 are moved to positions for adjusting the strength of elastic force, a stopper 60 is inserted into a gap between the facing parts 122 of the first arm 11 and the second arm 12 to limit separation of the first arm 11 and the second arm 12. In this case, the facing parts 122 are formed so that the gap between the facing parts 122 becomes larger in an upward direction. Thus, when the stopper 60 is inserted into and fixed to one of stopper insertion holes 25, a gap between the first arm 11 and the second arm 12 can be adjusted through a gap between the facing parts 122. Therefore, the plurality of stopper insertion holes 25 may be formed to pass through the front and rear plates in a vertical direction corresponding to the facing parts 122.

According to the operating-arm rotation limiting part 50, the stopper insertion holes 25 having a rectangular shape are formed to pass through the front plate 21 and the rear plate 22. The stopper 60 to be inserted into one of the stopper insertion hole 25 passes through the stopper insertion hole 25 and is inserted into and fixed to a gap between facing parts 122 of the first arm 11 and the second arm 12.

The stopper 60 is formed in a rectangular rod shape corresponding to the stopper insertion hole 25 and includes a grip 61 that protrudes forward to be gripped by a user and a supporting piece 62 that is integrally formed therein and inserted into the gap between the facing parts 122 to be supported. The stopper 60 includes a permanent magnet 63 that is inserted into an insertion hole 62*a*, which is formed in the supporting piece 62, and attached to a steel plate around the stopper insertion hole 25 of the front plate 21 and the rear plate 22 so as not to easily come out of the stopper insertion hole 25 while the supporting piece 62 is inserted into the gap between the facing parts 122. The grip 61 of the stopper 60 includes a nut hole 61*a* that corresponds to an outer circumferential diameter to allow the nuts 34 of the upper coupling parts 35 of the elastic members 30 to be easily fastened or unfastened.

Therefore, the stopper 60 is fixed to prevent the connection arm parts 120 of the first arm 11 and the second arm 12 from being spaced apart from each other to positions at which the strength of elastic force is adjustable by moving the connection arm parts 120 in the separation direction, and thus a smooth operation state of the operating arms 10 can be maintained within a limited operation section of the operating arms 10 in which the operating arms 10 approach and are spaced apart from each other.

Hereinafter, operation of the chest expander according to one embodiment of the present invention will be described with reference to the accompanying drawings.

Referring to the drawings, first, the stopper 60 is separated from the stopper insertion hole 25 of the head part 20 to adjust the strength of the elastic force of the elastic members 30 to fit muscular strength of the user. Since the operating arms 10 are maximally spaced apart by repulsive forces of the elastic members 30 to correspond to the elastic force adjusting holes 123 of the connection arm parts 120 on the rotation routes of the upper coupling parts 35 of the elastic members 30, the elastic forces can be adjusted. The upper coupling parts 35 of the elastic members 30 are moved to any one of the elastic force adjusting holes 123 so that the strength of elastic forces can be adjusted. In this case, the nuts 34 fixed to the coupling bolts 33 of the upper coupling parts 35 of the elastic members 30 are unfastened, the coupling bolts 33 are moved along the elastic force adjusting holes 123 and inserted into any one of the elastic force adjusting holes 123 to be fixed to fit the muscular strength of the user, and the nuts 34 are fastened to the coupling bolts 33 of the upper coupling parts 35 of the elastic members 30 so as to be symmetrically fixed to the determined elastic force adjusting hole 123.

To adjust the strength of the elastic force of the elastic members 30 to a low level, in a coupling portion of the upper coupling parts 35 of the elastic members 30 and the elastic force adjusting holes 123, the movement routes of the elastic force adjusting holes 123 are similar to rotation routes of the upper coupling parts 35 of the elastic members 30 while the operating arm parts 120 of the operating arms 10 are spaced apart each other. Therefore, the upper coupling parts 35 of the elastic members 30 positioned similar to the rotation routes may move upward along the movement routes of the elastic force adjusting holes 123 while rotating about the lower coupling parts 36 below the elastic members 30.

In the strength of elastic force provided to the chest expander, which is strength of elastic force provided when the operating arms 10 approach each other while being spaced apart from each other, when the upper coupling parts 35 of the elastic members 30 are moved to the upper elastic force adjusting holes 123, displacement in which the elastic members 30 are compressed when the operating arms 10 approach each other is changed, and thus force required in the event of exercise using the chest expander is decreased. On the contrary, to adjust the strength of the elastic force of the elastic members 30 to a high level, the upper coupling parts 35 of the elastic members 30 that rotate about the lower coupling parts 36 of the elastic members 30 are moved downward along the movement routes of the elastic force adjusting holes 123, and thus the force required in the event of exercise using the chest expander is increased.

Therefore, according to the chest expander according to one embodiment of the present invention, a distance between the operating arms 10 at the exercise starting positions is adjusted, and thus the strength of elastic forces can be adjusted. Thus, the user can exercise by adjusting elastic force of the chest expander according to strength of the user.

On the contrary, when a user with relatively strong muscular strength uses the chest expander according to one embodiment of the present invention, the upper coupling parts 35 of the elastic members 30 are moved downward along the movement routes of the elastic force adjusting holes 123, and thus the strength of elastic force applied to the chest expander can be increased.

When coil springs are used in the chest expander as the elastic members 30, since the coil spring is bent due to bending force applied in a lateral direction in the process of compression and relaxation of the coil spring, the coil spring may not provide an elastic force. However, according to the present invention, gas springs are used as the elastic members 30, end portions of the rods 31 inserted into the tubes 32 are guided by inner surfaces of the tubes 32 so that movement in a length direction is guided, and thus bending of the elastic members 30 can be prevented. As an elastic force providing method, an elastic force generated when the rods 31 compress gas in the tubes 32 is used, and thus a problem of damage to a spring coupling part can be solved.

The strength of elastic force provided to the chest expander, which is the strength of elastic force provided when the operating arms 10 spaced apart from each other approach each other, is determined according to displacement of the elastic members 30. As shown in the drawings, when the upper coupling parts 35 of the elastic members 30 are moved to an upper elastic force adjusting hole 123, the operating arms 10 approach each other, compression displacement of the elastic members 30 is changed, and thus force required in the event of exercise using the chest expander is decreased.

Hereinafter, in describing a chest expander according to another embodiment of the present invention, the same symbols are used for the same configurations and functions, and detailed descriptions thereof will be omitted to avoid repetitive configurations.

Figure 6:
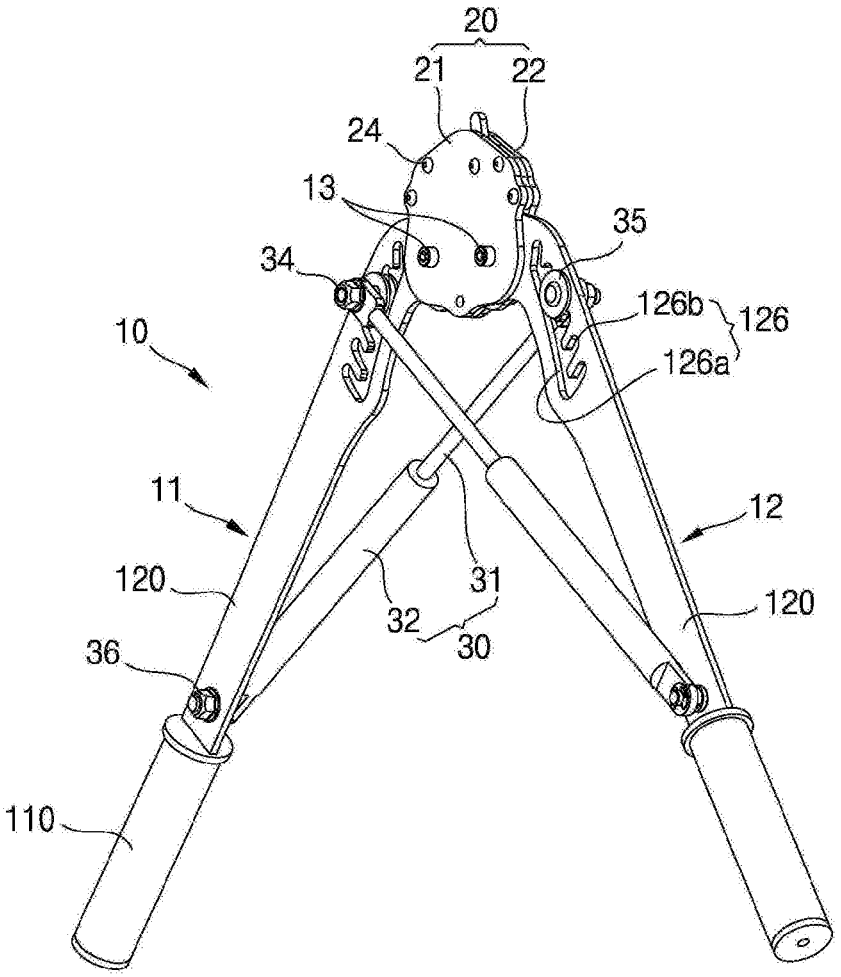
FIG. 6 is a perspective view illustrating a chest expander according to another embodiment of the present invention.
Figure 7:
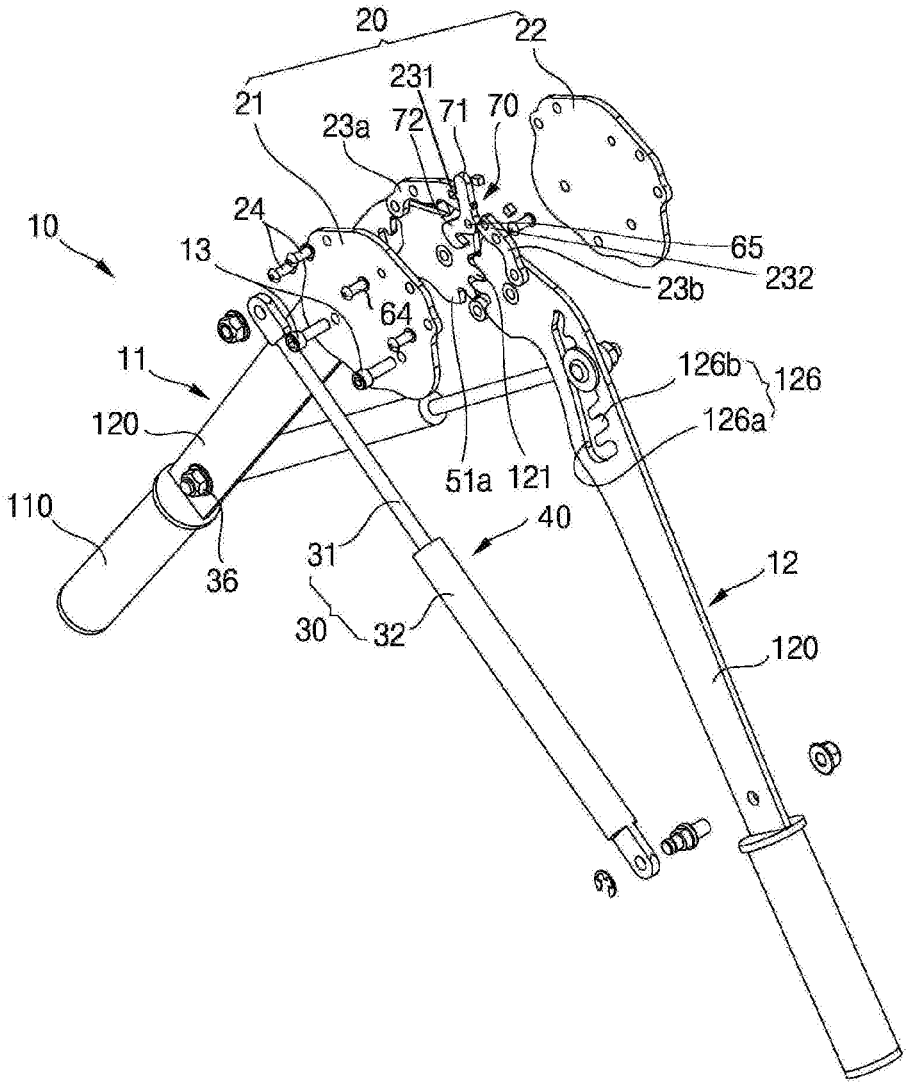
FIG. 7 is an exploded perspective view illustrating the chest expander according to another embodiment of the present invention.

As shown in FIG. 6, a pair of operating arms 10 including a first arm 11 and a second arm 12 include grip parts 110 which are formed of a plate-shaped member and include grips fixed to lower portions thereof and connection arm parts 120 connected from the grip parts 110 to upper end portions of the connection arm parts 120 positioned in a head part 20.

The connection arm parts 120 are formed of a plate-shaped member and are rotatable about rotating shafts 13 in the head part 20 to approach or be spaced apart from each other.

The head part 20 includes an installation space in which the pair of connection arm parts 120 are accommodated and installed and includes a front plate 21 and a rear plate 22 fixed to be spaced apart from each other, wherein the connection arm parts 120 are rotatable and face each other.

Upper end portions of the connection arm parts 120 of the first arm 11 and the second arm 12 are rotatably connected with rotating shafts 13 of the head part 20, teeth-shaped parts 121 which are partially engaged in a facing direction are formed on upper end portions of the connection arm parts 120, and a locking surface 26 and a locking protrusion 27 are included in an operating-arm rotation limiting part 50 formed in the connection arm parts 120 of the first arm 11 and the second arm 12, wherein the locking surface 26 and the locking protrusion 27 are fixed and locked by a stopper 70 formed above the teeth-shaped part 121.

When the connection arm parts 120 rotate about the rotating shafts 13 in an approaching direction, rotation limiting surfaces 51*a* and 51*b*, which are provided below the teeth-shaped parts 121, come into contact with each other so that rotation of the operating arms 10 are limited in a direction in which the operating arms 10 approach each other, and thus the rotation of the first arm 11 and the second arm 12 is stopped. That is, when the connection arm parts 120 approach each other with respect to the rotating shafts 13, the first arm 11 and the second arm 12 can rotate only to a position at which a rotation limiting surface 51*a* of the first arm 11 comes into contact with a rotation limiting surface 51*b* of the second arm 12.

Further, as described above, the operating-arm rotation limiting part 50 limits a separation degree of the first arm 11 and the second arm 12 while the position of the upper coupling parts 35 of the elastic members 30 for the elastic force adjusting holes 126 are adjusted. That is, when a user applies force so that the first arm 11 and the second arm 12 approach each other and removes the force, the first arm 11 and the second arm 12 rotate in a direction in which the first and second arms 11 and 12 are rotated about the rotating shafts 13 by an elastic force of the elastic members, and thus the separation degree of the first arm 11 and the second arm 12 should be limited so that the first arm 11 and the second arm 12 are not spaced apart from each other by the maximum rotation distance. That is, when the operating arms 10 are spaced apart from each other over a predetermined range, the elastic members 30 are not compressed to be in a release state in which the upper coupling parts 35 of the elastic members 30 are positioned on the rotation routes of the elastic force adjusting holes 123. Therefore, a separation degree of each of the operating arms 10 should be limited.

Thus, a stopper 70 is fixed to prevent the operating arm parts 120 of the first arm 11 and the second arm 12 from moving in a direction in which the first and second arm are spaced apart from each other and to prevent the elastic members 30 from being spaced apart to a position at which the strength of elastic force is adjustable so that the elastic members 30 are not compressed.

To achieve this, in the present invention, the stopper 70 is disposed between a first interposing part 23*a* and a second interposing part 23*b* between the front plate 21 and the rear plate 22. The stopper 70 is disposed between the first interposing part 23*a* and the second interposing part 23*b* and coupled to be rotatable about a hinge shaft 64. To this end, the front plate 21, the rear plate 22, and the stopper 70 have hinge holes 65 for inserting and coupling the hinge shaft 64.

Figure 8:
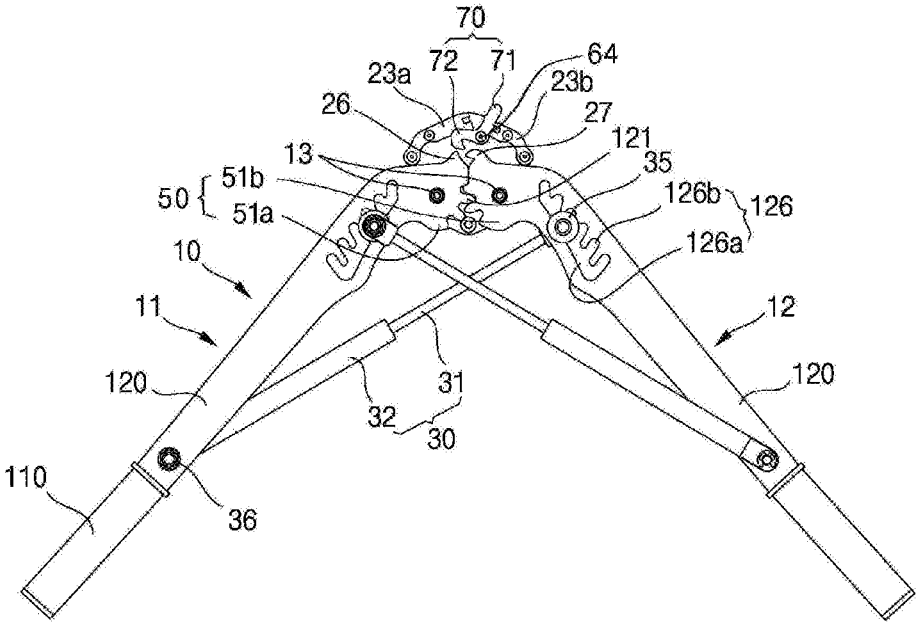
FIG. 8 is a cross-sectional view illustrating a state in which the operating arms of the chest expander according to another embodiment of the present invention are spaced apart from each other.

The stopper 70 includes a rotation knob 71 that protrudes upward. The rotation knob 71 is used when the stopper 70 rotates about the hinge shaft 64 in a clockwise direction. The stopper 70 includes a hook 72 formed on a lower portion thereof and fixedly locked between the locking surface 26 and the locking protrusion 27 of the connection arm parts 120 of the second arm 12 so as to limit the separation degree of the first arm 11 and the second arm 12. That is, when a user applies force so that the first arm 11 and the second arm 12 approach each other and removes the force, the first arm 11 and the second arm 12 rotate in a direction in which the first and second arms 11 and 12 are rotated about the rotating shafts 13 by an elastic force of the elastic members. As shown in FIG. 8, when the operating arms 10 are spaced apart from each other over a predetermined range, the elastic members 30 are not compressed to be in a release state in which the upper coupling parts 35 of the elastic members 30 are positioned on the rotation routes of the elastic force adjusting holes 123, and the upper coupling parts 35 of the elastic members 30 may come out of the elastic force adjusting holes 126, and thus a separation degree of the operating arms 10 can be limited.

Figure 9:
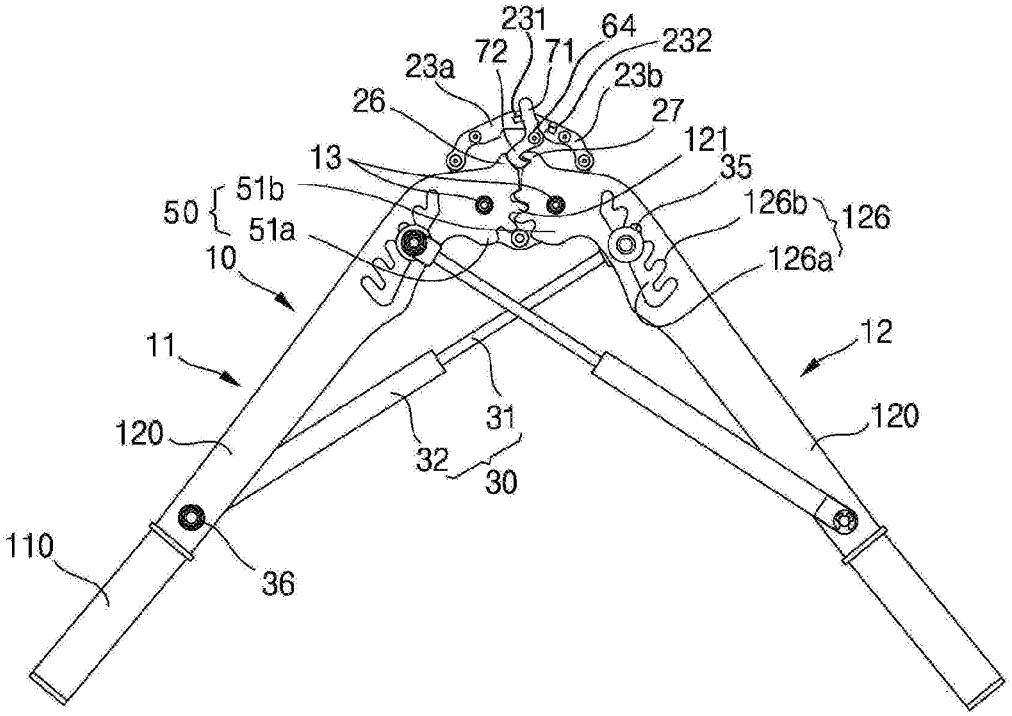
FIG. 9 is a cross-sectional view illustrating a state in which a stopper of the chest expander according to another embodiment of the present invention is fixed.

Therefore, as shown in FIG. 9, the stopper 70 is fixed to prevent the upper coupling parts 35 of the elastic members 30 positioned on the rotation routes of the elastic force adjusting holes 126 from reaching a state in which positions of the upper coupling parts 35 of the elastic members 30 for the elastic force adjusting holes 126 are adjustable, and thus a state in which the operating arms 10 are smoothly operated can be maintained within limited rotation operation sections of the operating arms 10.

When the rotation knob 71 rotates about the hinge shaft 64 so that the hook 72 provided on a lower portion of the stopper 70 is positioned between the locking surface 26 and the locking protrusion 27 of the first arm 11 and the second arm 12, the stopper 70 limits the separation degree of the first arm 11 and the second arm 12.

The coupling grooves 231 and 232 are formed between facing surfaces of the first interposing part 23*a* and the second interposing part 23*b* so that a protrusion of the stopper 70 rotates to be coupled thereto.

Thus, the stopper 70 is fixed to prevent the operating arm parts 120 of the first arm 11 and the second arm 12 in a direction in which the first and second arms are spaced apart from each other and the elastic members 30 from being spaced apart to a position at which the strength of elastic force is adjustable so that the elastic members 30 are not compressed. Therefore, a state in which the operating arms 10 are smoothly operated can be maintained within limited rotation operation sections of the operating arms 10.

The first arm 11 and the second arm 12 of the connection arm parts 120 include the elastic force adjusting holes 126 through which the coupling bolts 33 of the upper coupling part 35 of the elastic members 30 pass and which are formed on the rotation routes of the upper coupling parts 35 with respect to the lower coupling parts 36 of the elastic members 30.

Each of the elastic force adjusting holes 126 has an opening shape formed in the connection arm part 120 in a length direction and includes a slide hole 126*a* and a plurality of fixing holes 126*b*, wherein the slide hole 126*a* has a straight line shape and allows the upper coupling part 35 of the elastic member 30 to move on the rotation route of the upper coupling part 35 of the elastic member 30, and the fixing holes 126*b* are formed at intervals to cross the slide hole 126*a* and allow the upper coupling parts 35 of the elastic members 30 to be inserted and fixed.

Therefore, the coupling bolts 33 of the upper coupling parts 35 of the elastic members 30 rotate about the lower coupling parts 36 of the elastic members 30 to be inserted into and fixed to any one of the fixing holes 126*b* of the elastic force adjusting holes 126 on the rotation routes and can easily adjust strength levels to fit muscular strength of the user by adjusting lengths of the elastic members 30, that is, elastic force adjusting parts 40.

Therefore, the upper coupling parts 35 of the elastic members 30 are guided along the slide hole 126*a* of the plurality of elastic force adjusting holes 126 by the elastic force adjusting parts 40 symmetrically formed on the connection arm parts 120 of the first arm 11 and the second arm 12 and may be inserted into and fixed to any one of the fixing holes 126*b* formed on the slide hole 126*a* at intervals, and thus the upper coupling parts 35 of the elastic members 30 may adjust the strength of the chest expander according to the muscular strength of the user in various levels. In this case, when the upper coupling parts 35 of the elastic members 30 are inserted into and fixed to the elastic force adjusting holes 126, the upper coupling parts 35 may be inserted into the elastic force adjusting holes 126, which are positioned symmetrically, of the first arm 11 and the second arm 12. When the separation degree of the connection arm parts 120 is increased over a predetermined range, the upper coupling parts 35 of the elastic members 30 may be positioned on the rotation routes of the elastic force adjusting holes 126, and thus the positions of the elastic members 30 for the elastic force adjusting holes 126 can be adjusted.

In one embodiment of the present invention, when positions of the elastic members 30 for the elastic force adjusting holes 126 are adjusted, the nuts 34 fixed to the coupling bolts 33 of the upper coupling parts 35 of the elastic members 30 are unfastened, the coupling bolts 33 are moved and inserted into any one of the elastic force adjusting holes 126 to fit the muscular strength of the user, and the nuts 34 are fixed, and thus the positions of the elastic members 30 for the elastic force adjusting holes 126 can be adjusted. However, in another embodiment of the present invention, while the upper coupling parts 35 of the elastic members 30 are moved upward or downward along the slide hole 126*a* in a state in which the nuts 34 are coupled to the coupling bolts 33 of the upper coupling parts 35 of the elastic members 30 so as to adjust the positions thereof, and the operating arms 10 are pulled to the approaching direction and inserted into the fixing holes 126*b* to be fixed, the hook 72 of the stopper 70 is inserted into and fixed to a gap between the locking surface 26 and the locking protrusion 27 of the upper end portions of the connection arm parts 120, and thus a smooth operation state of the operating arms 10 can be maintained within a limited rotation operation section of the operating arms 10.

Hereinafter, operations of the chest expander according to another embodiment of the present invention will be described with reference to the accompanying drawings.

Referring to the drawings, in order for a user, such as children having weak muscular strength, to adjust an elastic force to fit muscular strength of the user, first, the knob 71 of the stoppers 70 rotates about the hinge shaft 64 in a clockwise direction so that the hook 72 is unlocked from a gap between the locking surface 26 and the locking protrusion 27 of the first arm 11 and the second arm 12. When the operating arms 10 are maximally spaced apart by a repulsive force of the elastic members 30, the elastic force adjusting holes 126 of the connection arm parts 120 correspond to the rotation routes of the upper coupling parts 35 of the elastic members 30, and thus strength of the elastic force can be adjusted. The upper coupling parts 35 of the elastic members 30 are moved upward along the slide hole 126*a* of the elastic force adjusting holes 126 and inserted into the fixing hole 126*b* to be fixed, and thus the strength of elastic force applied to the chest expander can be decreased. On the contrary, when a user with relatively strong muscular strength uses the chest expander according to one embodiment of the present invention, the upper coupling parts 35 of the elastic members 30 are moved downward along the movement routes of the elastic force adjusting holes 126, and thus the strength of elastic force applied to the chest expander can be increased.

According to the chest expander according to the above-described present invention, the chest expander allows a user to easily adjust a strength level of elastic force to fit muscular strength of the user in the case of exercise using the chest expander.

The above description is only exemplary, and it should be understood by those skilled in the art that the invention may be performed in other concrete forms without changing the technological scope and essential features. Therefore, the above-described embodiments should be considered as only examples in all aspects and not for purposes of limitation. The scope of the present invention is defined not by the detailed description but by the appended claims, and encompasses all modifications or alterations derived from meanings, the scope, and equivalents of the appended claims.

What is claimed is:

1. A chest expander comprising:

a head part;

two operating arms each connected to the head part by a rotating shaft and configured to approach or be spaced apart from each other;

elastic members that are disposed between the operating arms to cross and configured to provide an elastic force in a direction in which the operating arms are spaced apart from each other due to compression deformation that causes a decrease in length when the operating arms approach each other, wherein each elastic member has an upper coupling portion connected to one of the operating arms and a lower coupling portion connected to the other of the operating arms; and elastic force adjusting parts that allow the upper coupling portions of the elastic members to move along the operating arms and to be fixed so that a strength of elastic force provided by the elastic members when the operating arms approach each other is adjusted;

wherein the operating arms include teeth-shaped parts formed on upper end portions thereof and including gear teeth for engaging so that the operating arms are rotated to approach or be spaced apart from each other with the teeth-shaped parts being engaged with each other.

2. The chest expander of claim 1, wherein the elastic force adjusting part includes elastic force adjusting holes formed in a longitudinal direction of the operation arm and the upper coupling portion of the elastic member moves along the elastic forces adjusting holes and is fixed so as to adjust the strength of elastic force provided by the elastic members.

3. The chest expander of claim 2, wherein the elastic force adjusting holes are formed to pass through the operation arm on a rotation route of the upper coupling portion of the elastic member with respect to the lower coupling portion of the elastic member and the elastic force adjusting part allows the upper portion of the elastic member to be fixed to one of the elastic force adjusting holes.

4. The chest expander of claim 2, wherein the elastic force adjusting holes are formed as through holes consecutively formed on the operation arm along a rotating route of the upper coupling portion of the elastic member.

5. The chest expander of claim 2, wherein the elastic force adjusting holes include:

a straight slide hole formed on the operating arm along a rotation route of the upper coupling portion of the elastic member to allow the upper coupling portion of the elastic member to move; and a plurality of fixing holes that are formed interval to cross the slide hole and allow the upper coupling portion of the elastic member to be inserted and fixed thereto.

6. The chest expander of claim 1, further comprising an operating-arm rotation limiting part formed on the upper end portion of the operating arm and configured to limit approach of the operating arms when the operating arms approach each other or separation of the operating arms when the operating arms are spaced apart from each other.

7. The chest expander of claim 6, wherein the head part comprises a front plate and a rear plate that are fixed to be spaced apart each other to form an installation space therebetween in which the upper ends of the operating arms are accommodated.

8. The chest expander of claim 7, wherein the operating-arm rotation limiting part includes rotation limiting surfaces to limit rotation in a direction in which the operating arms approach each other by coming into contact with each other, wherein the rotation limiting surfaces are formed below the teeth-shaped parts of the operating arms accommodated in the head part.

9. The chest expander of claim 7, wherein the operating-arm rotation limiting part includes:

a stopper insertion hole formed to pass through the front plate and the rear plate of the head part; and facing parts formed above the teeth-shaped parts on the upper end portions of the operating arms to face each other; and a stopper configured to be inserted into the stopper insertion hole and to be fixed to a gap between the facing parts of, wherein the operating-arm rotation limiting part limits a rotation distance between the operating arms spaced apart by the stopper.

10. The chest expander of claim 9, wherein:

the stopper is formed in a rod shape corresponding to a shape of the stopper insertion hole; and the stopper includes a grip protruding forward outside the stopper insertion hole and a supporting piece that is inserted into the stopper insertion hole and the gap between the facing surfaces.

11. The chest expander of claim 10, wherein the stopper includes a permanent magnet inserted into an insertion hole formed in the supporting piece, wherein the permanent magnet enables the stopper to be attached magnetically to the front plate or the rear plate while the stopper is being inserted into the stopper insertion hole.

12. The chest expander of claim 10, wherein the grip of the stopper includes a nut hole that corresponds to an outer circumferential diameter a nut of the upper coupling portion of the elastic member so that the nut of the upper coupling portion of the elastic member is unfastened or fastened using the stopper.

13. The chest expander of claim 9, wherein the stopper insertion hole is comprised of a plurality of stopper insertion holes disposed in a vertical direction on the head part.

14. The chest expander of claim 7, wherein the operating-arm rotation limiting part includes:

a stopper that is rotated by a hinge shaft between the front plate and the rear plate of the head part and includes a rotation knob formed on an upper portion thereof and a hook formed on a lower portion thereof; and a locking surface and a locking protrusion formed on the upper end portions of the operating arms, wherein the operating-arm rotation limiting part limits a rotation distance between the two operating arms spaced apart by the hook of the stopper fixed to a gap between the locking surface and the locking protrusion.

15. The chest expander of claim 14, wherein:

the front plate and the rear plate are disposed with a first interposing part and a second interposing part disposed therebetween; and the stopper is rotatably disposed between the first interposing part and the second interposing part.

* * * * *